US009288562B2

(12) United States Patent
Andersen et al.

(10) Patent No.: US 9,288,562 B2
(45) **Date of Patent: *Mar. 15, 2016**

(54) MICROPHONE BOOM

(71) Applicant: SENNHEISER COMMUNICATIONS A/S, Ballerup (DK)

(72) Inventors: Esge Brandt Andersen, Campbell, CA (US); Claus Benjaminsen, Somerville, MA (US); Svend Feldt, Ballerup (DK); Christian Wang, Ballerup (DK); Torben Christiansen, Ballerup (DK); Brian Brorsbøl, Ballerup (DK)

(73) Assignee: SENNHEISER COMMUNICATIONS A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 14/788,308

(22) Filed: Jun. 30, 2015

(65) Prior Publication Data

US 2015/0304749 A1 Oct. 22, 2015

Related U.S. Application Data

(63) Continuation of application No. 14/103,368, filed on Dec. 11, 2013, now Pat. No. 9,100,737.

(60) Provisional application No. 61/736,014, filed on Dec. 12, 2012.

(30) Foreign Application Priority Data

Dec. 12, 2012 (EP) ..... 12196629

(51) Int. Cl.
*H04R 1/02* (2006.01)
*H04R 1/08* (2006.01)

(52) U.S. Cl.
CPC ... *H04R 1/02* (2013.01); *H04R 1/08* (2013.01)

(58) Field of Classification Search
CPC ..... H04R 1/00; H04R 2205/022; H04R 2201/401; H04R 2201/405; H04R 25/00; H04R 1/105; H04R 1/02; H04R 1/025; H04R 1/026
USPC ..... 381/313, 182, 381, 387–390
See application file for complete search history.

(56) References Cited

U.S. PATENT DOCUMENTS 3,604,861 A * 9/1971 Lewis ..... G02C 11/06 381/327
4,206,324 A * 6/1980 Horikawa ..... H04R 5/027 381/26

(Continued)

FOREIGN PATENT DOCUMENTS

WO WO 03/079486 A1 9/2003
WO WO 2008/112302 A1 9/2008

*Primary Examiner* — Suhan Ni
(74) *Attorney, Agent, or Firm* — Birch, Stewart, Kolasch & Birch, LLP

(57) ABSTRACT

A microphone boom is provided with an extendable microphone assembly, and a headset having such a microphone boom. The headset includes a casing accommodating the signal transmission circuitry and further includes a speaker adapted to serve a sound signal at the proximity of a user's ear and the speaker is protruding from the casing at a speaker-end of the casing and a microphone assembly is fixated relative to the casing distally with respect to the speaker-end.

19 Claims, 4 Drawing Sheets
(4 of 4 Drawing Sheet(s) Filed in Color)

(56) References Cited

U.S. PATENT DOCUMENTS 6,091,832 A * 7/2000 Shurman ..... G02C 11/06
381/381

6,473,514 B1 10/2002 Bodley et al.
2009/0310811 A1 12/2009 Inoda et al.
2010/0321878 A1 12/2010 Huang

* cited by examiner

MICROPHONE BOOM

CROSS-REFERENCE TO RELATED APPLICATIONS

This application is a Continuation of application Ser. No. 14/103,368, filed on Dec. 11, 2013, which claim priority under 35 U.S.C. §119(e) to U.S. Provisional Application No. 61/736,014 filed on Dec. 12, 2012. This application also claims priority under U.S.C. §119(a) to Patent Application No. 12196629.5 filed in Europe on Dec. 12, 2012. The entire contents of all of the above applications is hereby incorporated by reference.

AREA OF THE INVENTION

A microphone boom and a headset with a microphone boom are provided.

BACKGROUND OF THE INVENTION

Microphone booms having an array of microphones for obtaining a directional signal are known. Such booms must comply with certain measures regarding spacing of the microphones in case improved directional characteristics are desired. A boom with good storage capability is desired, which also maximize the effect of the number of microphones on the boom. In headsets it is known to provide a boom arm with two or more microphones, such that the microphones provide an array pointed towards the mouth of the user, with the view to derive a directional signal by combining the signals from the microphones in a predefined manner. It is also known to provide a microphone on a movable boom arm, whereby movement of the boom arm will control on/off function of the headset. A headset with good storage capability is desired, wherein maximum effect of the microphone array is obtained at the same time.

SUMMARY OF THE INVENTION

A microphone boom comprising a first group of microphones with two or more microphones fixated along a first axis and a second group of microphones fixated along a second axis is provided, and the first and the second groups of microphones are movably mounted with respect to each other. This allows the two arrays to be collapsed with respect to each other, when the boom is not in use and needs to be stored. In this way major directional characteristics may be obtained while the boom remains easy to store.

Further, a headset is provided having such a microphone boom. Such a boom allows the headset to be both efficient to store and efficient in avoiding noise.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF THE DRAWINGS

The patent or application file contains at least one color drawing. Copies of this patent or patent application publication with color drawing will be provided by the USPTO upon request and payment of the necessary fee.

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only.

DESCRIPTION OF A PREFERRED EMBODIMENT

Figure 1:
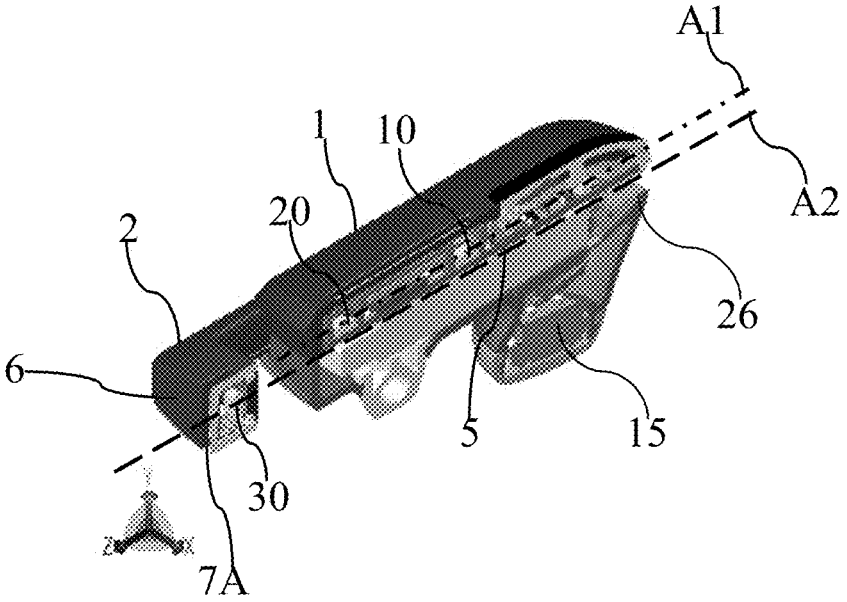
FIGS. 1 and 1A shows a microphone boom in a 3d projectional view and sectioned through the middle.
Figure 1A:
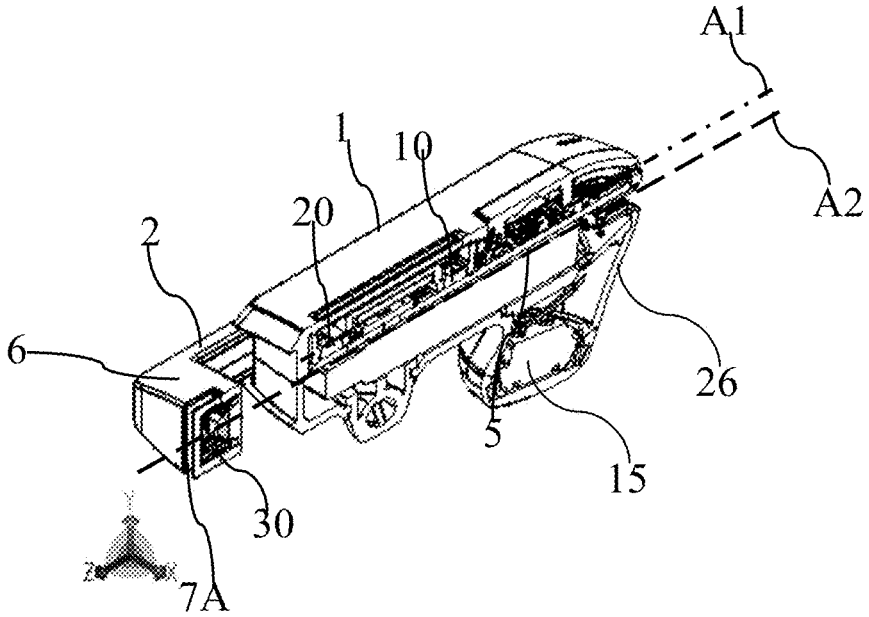
Figure 2:
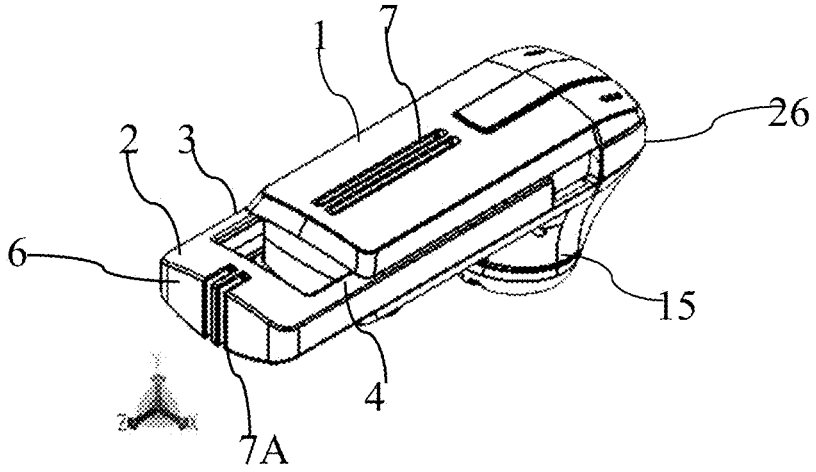
FIG. 2 is a 3d projectional view of the headset with the slider 2 in its extended position.

In FIGS. 1 and 1A a microphone boom is shown in a 3*d* projectional view and sectioned through the middle. The boom comprises a first group of two or more microphones 10,20 fixated along a first axis A1, and a second group of microphones 30 fixated along a second axis A2. The first group and the second group of microphones 10,20,30 are movably mounted with respect to each other. As seen in FIG. 2 the first axis A1 and the second axis A2 are parallel.

If nothing else is specified, the term "group" is to be understood in this specification as comprising one, two or more items.

A microphone as used here is a unit with a single electric output signal and one or more sound input passages, such as a directional microphone which has two sound input passages, or an omnidirectional microphone which usually has one sound input passage. A directional microphone will provide an electrical output signal with enhanced sensitivity for sounds originating in a predetermined direction with respect to the sound input openings. An omnidirectional microphone provides electrical output signal with signal strength which is independent of the direction from which the sound originates.

The first group of microphones 10,20 is fixated to a casing 1. The casing 1 accommodates signal transmission circuitry 5, and further the second group is fixated to a slider 2 slidably arranged with respect to the casing 1 and the first group in the direction of the first axis A1 and the second axis A2. The two microphone groups may then be slidably positioned with respect to each other in the direction defined by a line passing through the two microphone 10,20 in the first group. This allows the two groups to be arranged such that the microphones in the two groups will form a single combined array with optimal distance between the microphones, and thereby enhance the directionality effect.

According to array theory and measurements, a voice signal which is captured with an array of microphones from the most sensitive direction will gain in understandability with every added microphone element, and moving from an array of two microphones which is known in headsets to three microphones will add up to 10% to the ratio of a speech signal which the far end user of a headset system will be able to understand. In terms of free field directionality index this amount to an increase of 3 db when going from an array of 2 microphones to an array of 3 microphones. One important down side of doing this is the added size, notably the length needed in order to obtain this increase. A solution to this problem is provided, which also ensures mechanical stability and ruggedness of the device.

In FIG. 2 the slider 2 for the second group of microphones is visible, and it is u-shaped with two legs 3,4 and an interconnection 6 connecting the two legs 3,4. The slider 2 has openings 7A, and the casing 1 likewise has openings 7, such that sound may enter the openings 7,7A and reach the microphones 10,20,30. All of the microphone openings are protected with a mesh or similar protection in order to protect the delicate microphones.

Figure 3:
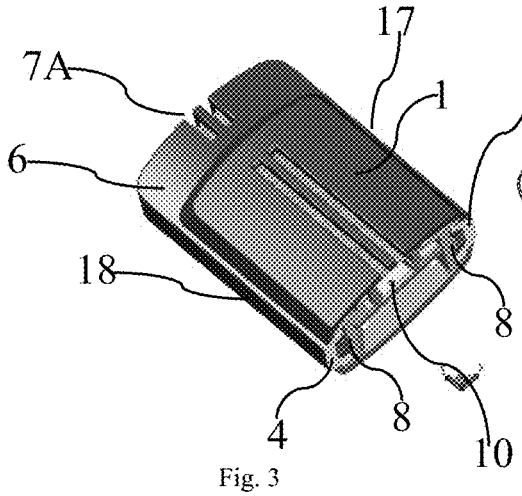
FIGS. 3 and 3A are 3d projectional views of a section through the front part of the headset with the slider in closed position.
Figure 3A:
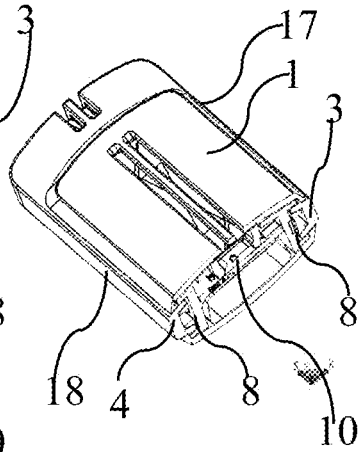

In the sectional view of FIG. 3, it can be seen how the two legs of the u-shaped slider 2 are arranged to embrace the casing 1 and slide in open tracks 8 on two opposed sides of the casing 1. In FIGS. 3 and 3A the slider is shown in the closed position and in FIGS. 1 and 2 it is shown in an open position.

The slider moves a distance of around 7 mm from closed to open position, and this movement sets the distance between the microphone 30 in the slider and the closest microphone 20 in the casing to about 17 mm. The distance between the two microphones in the casing 1 remains constant and is around 16 mm. These distances provides the desired directionality of the system when the microphones are placed apart for operation, and at the same time a very compact unit is provided when the slider is pushed to its closed position with the two of the microphones close together.

Preferably the first and the second group of microphones define a combined directional group or array when the u-shaped slider 2 is in the open position. This ensures further, that the combined array has the longest distance from the foremost microphone 30 to the rearmost microphone 10 and thereby the best directional characteristic.

Figure 4:
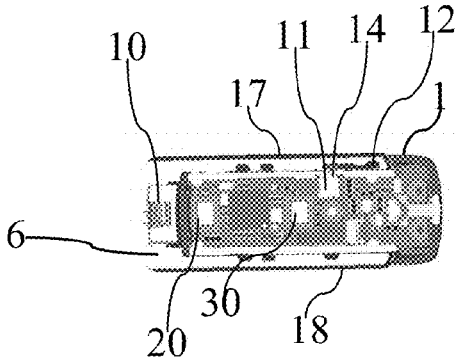
FIGS. 4 and 4A are sectional views through the headset with the slider 2 in its two end-positions respectively.
Figure 4A:
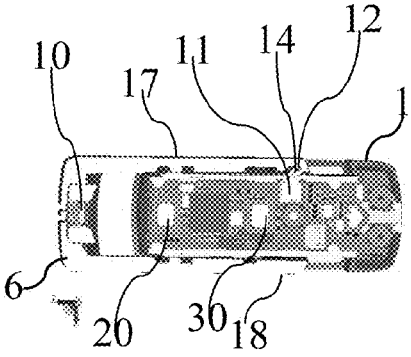
Figure 5:
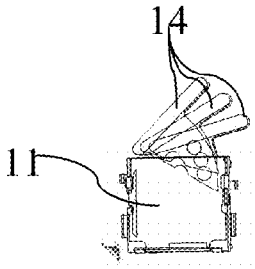
FIG. 5 is a front view of the switch 11 and lever 14.

In the sectional view of FIG. 4 the boom arm is shown closed with the slider 2 pushed in, and in FIG. 4A it is shown extended with the slider 2 pulled out, and as seen, in the pulled out position the three microphones 10,20,30 are evenly spaced apart from each other. A switch 11 is provided to assume a first position defining a first electrical contact configuration when the u-shaped slider 2 is in the closed position as shown in FIG. 4 and to assume a second position defining a second electrical contact configuration when the u-shaped slider 2 is in an open position as shown in FIG. 4A. The switch 11 is maneuvered by way of a lever 13, which abuts an internal side of the leg 4, and a recessed portion 12 in the leg 4 allows for the movement between the two positions of the lever 13. In FIG. 5 the lever 13 is shown in 3 different positions, in order to illustrate its movement between the first and the second electrical contact configuration. The position of the lever 13 may then determine whether the microphone boom is active or not, and/or whether the electronic circuitry 5 or parts thereof is in a switched on or switched off state. The shift of the switch may further be used to control one or more signal processing parameters, e.g. the aggressiveness of a noise reduction, directionality algorithm, feedback suppression algorithm, the frequency dependency of the sound processing, or others, in order to optimize or adapt the signal processing to the respective microphone positions and arrangements achieved when operating the slider.

It is preferred that some sort of tactility is provided for the user such that the movement of the u-shaped slider relative to the casing is counteracted by a counteracting force generated by a spring, a magnetic or a frictional element or combinations thereof. These measures allow the user to receive tactile feedback so that the reach of end-positions of the slider 2 is signaled to the user through his or her fingertips. Also the counteracting force may facilitate some degree of arrest of the u-shaped slider in its end positions or if desired any number of intermediate positions, so that in-advertent shift from one to another position is avoided.

The counteracting force may be provided between one leg of the u-shaped slider and the casing. This is a simple solution; however it will inevitably result in a difference in counteracting force between the two legs.

The counteracting force may be provided between each of the legs 3,4 of the u-shaped slider 2 and the casing 1 which will result in a balanced force, so that each leg will provide the same counteracting force.

As seen in FIG. 1 the casing 2 accommodates the signal transmission circuitry 5 which is connected to a speaker 15. The speaker 15 is adapted to serve a sound signal at the proximity of a user's ear and shaped to enter the concha in order to deliver a speaker signal close to the ear canal. Thus the speaker 15 is protruding from the casing 2 at a speaker-end 26 of the casing 2 and further the first microphone group is fixated relative to the casing distally with respect to the speaker-end 26. When the speaker 15 is mounted in the ear, the boom arm may be directed toward the mouth of the user in order to better pick up a voice signal from the user.

Figure 1C:
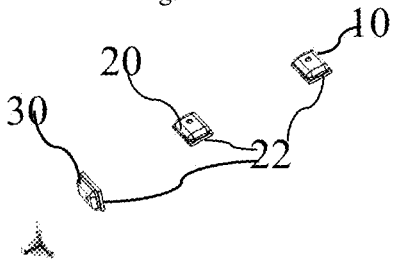
FIG. 1C shows the microphones of the two groups.

As seen in FIG. 1A the first microphone group comprises two microphones 20,30 and the second microphone group comprises one microphone 10 and the microphones used are electret microphones with a membranes (not shown) which are parallel to a mounting base 22 of the microphones. It is preferred that the microphones 20,30 in the first group have microphone membranes arranged in a first common direction with respect to the headset and that the microphones 10 of the second group have microphone membranes arranged perpendicular to said first direction as illustrated in FIG. 1C. This may help in dampening vibration and noise signals picked up by the microphones. The groups may each comprise a larger number of microphones.

As seen in FIG. 1A and FIG. 2 the microphones 10,20,30 and the speaker 15 are arranged in a common plane, and further the two legs of the u-shaped slider are provided to slide in tracks 8 provided at each their side of the common plane. When the protruding speaker 15 is inserted into the concha of the ear, the two microphone groups will extend along a cheek of a user, and thus the two legs of the u-shaped slider may be easily pinched between two fingers and extended to turn the headset on, or collapsed to turn it off by way of the switch 11.

To this end, the two legs of the u-shaped slider form exterior surface parts 17,18 along the casing 1, and these surface parts 17,18 may protrude beyond the perimeter of the casing in order for the user to gain an easy grip on these parts 17,18. This may be seen in FIGS. 4 and 4A.

As seen in FIG. 4A the microphone 10 in the second group is situated at the interconnection 6 between the two legs 3,4 of the u-shaped slider 2.

Figure 6:
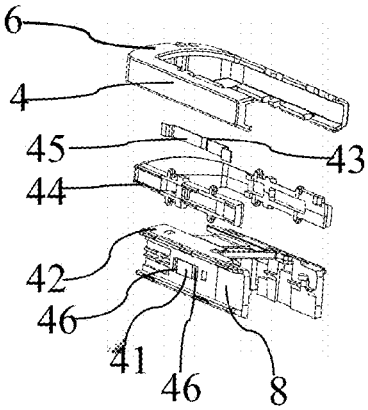
FIG. 6 shows an exploded view of the central parts of the slider 2 and the tracks 8.
Figure 7:
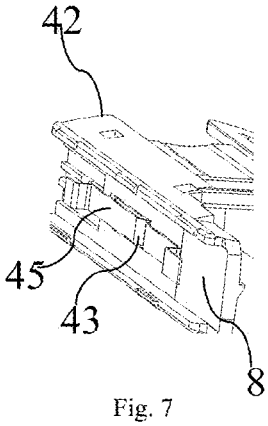
FIG. 7 shows a 3*d* projection of the chassis and spring 45.
Figure 8:
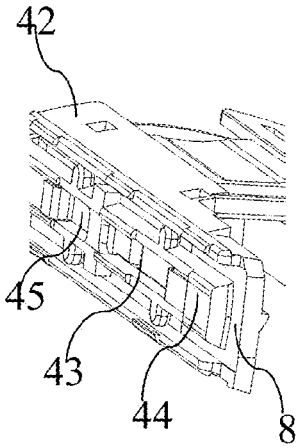
FIG. 8 is a projectional view of some of the elements of FIG. 6 in an operational position.

In FIGS. 6-9 the function of a cam follower 43 and a cam surface 41 is illustrated, which will provide the counteracting and holding force against movement of the slider 2 with respect to the casing 1. In the exploded views of FIG. 6 and FIG. 9 the cam surface 41 is visible and forms part of a chassis 42 and opposes the cam follower 43. Thus the leg 4 of the u-shaped slider 2 and an opposed surface forming a track 8 in the chassis 42 are arranged such that the cam follower 43 is elastically pressed against the cam surface 41 and slides along this surface during motion of the u-shaped slider 2 between open and closed positions. An intermediate frame 44 is provided to hold the cam follower in place. The cam follower 43 is shaped as a part of a blade spring 45 and this spring is fixed with respect to the intermediate frame 44 which again is fixed in the u-shaped slider 2. In FIG. 7 only the blade spring 45 and the chassis 42 are shown in an operative position, whereas in FIG. 8 also the intermediate frame 44 is shown in a similar operative position. The cam surface 41 has curves 46 which will deform the spring 45, when the cam follower 43 is pressed against the surface 41, and preferably the spring 45 is elastically deformed when the u-shaped slider 2 is positioned between the open and the closed position and is most undeformed when the slider 2 is at its outermost closed or open positions.

Figure 9:
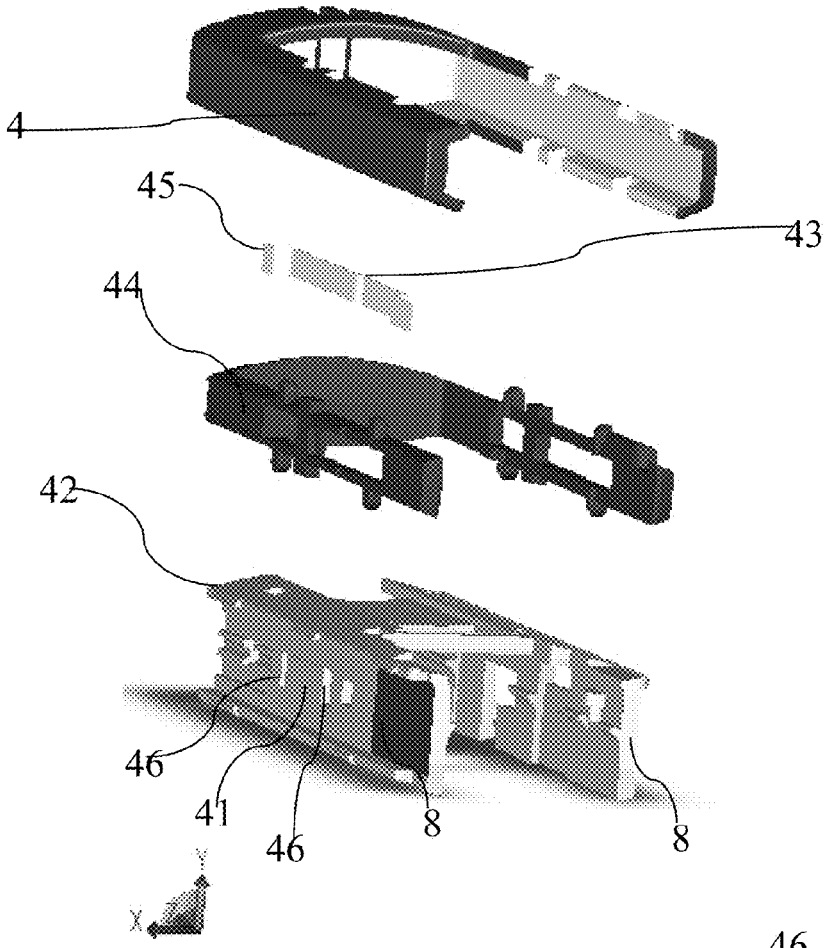
FIG. 9 shows an exploded view as in FIG. 6, with a computer-generated shaded graphics.

The cam surface 41 may be arranged to gradually deform the spring 45 through the cam follower 43 during motion from a closed or open position to a position at a point between closed and open position, such that a maximum deformation of the cam spring 45 is reached at this point. With such an arrangement, it may be ensured, that the slider is always urged towards one of its end-points. As seen in FIGS. 6 and 9, the embodiment shown here has a cam surface 41 with a long even path and curves 41 only at the end-points. In this embodiment the u-shaped slider 2 will be at rest, when the cam follower 43 is placed at the even path and only urged to the endpoints during the very last part of the movement towards an endpoint.

Figure 9A:
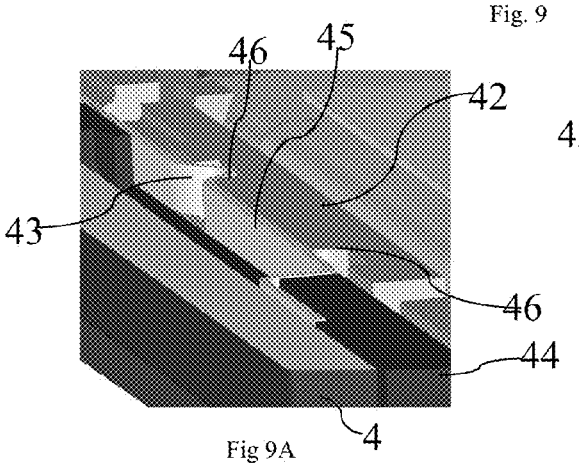
FIGS. 9A and 9B are similar 3*d* projections of a sectional view of a detail with the cam and cam follower in line drawing and shaded graphics respectively.
Figure 9B:
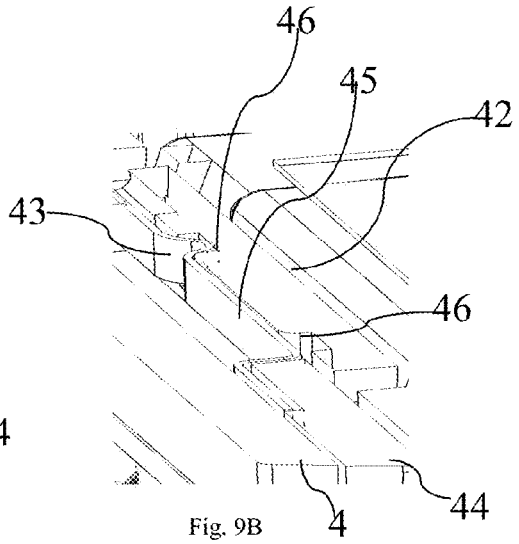

FIGS. 9A and 9B is an enlarged detail of a section through the spring 45 with the cam follower 43. Also the chassis 42, the intermediate part 44 and the u-shaped slider are visible, and shown all in assembled state, however with the u-shaped slider in its most extended position.

The invention claimed is:

1. A microphone boom, comprising:

a first microphone assembly fixated along a first axis and a second group of microphones with one or more microphones fixated along a second axis, the first axis and the second axis being offset from each other, wherein the first microphone assembly and the second group of microphones are movably mounted with respect to each other, and the first microphone assembly is fixated to a casing accommodating signal transmission circuitry, and the second group of microphones is mounted to slide with respect to the casing and the first microphone assembly along the second axis.

2. The microphone boom as claimed in claim 1, wherein the first and the second axis are always parallel.

3. The microphone boom as claimed in claim 1, wherein the second group of microphones is mounted in a u-shaped slider having two legs and an interconnection connecting the legs.

4. The microphone boom as claimed in claim 3, wherein the two legs of the u-shaped slider are arranged to embrace the casing and slide in open tracks on two opposed sides of the casing between a closed position and an open position.

5. The microphone boom as claimed in claim 4, wherein the first microphone assembly and the second group of microphones define a combined directional array of microphones when the u-shaped slider is in the open position.

6. The microphone boom as claimed in claim 4, wherein a switch is provided to assume a first position defining a first electrical contact configuration when the u-shaped slider is in a closed position and to assume a second position defining a second electrical contact configuration when the u-shaped slider is in an open position.

7. The microphone boom as claimed in claim 4, wherein the movement of the u-shaped slider relative to the casing is counteracted by a counteracting force generated by a spring, a magnetic or a frictional element or combinations thereof.

8. Microphone boom as claimed in claim 7, wherein the counteracting force is provided between one leg of the u-shaped slider and the casing.

9. Microphone boom as claimed in claim 7, wherein the counteracting force is provided between each of the legs of the u-shaped slider and the casing.

10. A headset, comprising:

a microphone boom including a first microphone assembly fixated along a first axis and a second group of microphones with one or more microphones fixated along a second axis, the first axis and the second axis being offset from each other, wherein the first microphone assembly and the second group of microphones are movably mounted with respect to each other, and the first microphone assembly is fixated to a casing accommodating signal transmission circuitry, and the second group of microphones is mounted to slide with respect to the casing and the first microphone assembly along the second axis.

11. The headset as claimed in claim 10, wherein the casing accommodating the signal transmission circuitry further comprise a speaker, adapted to serve a sound signal at the proximity of a user's ear, the speaker is protruding from the casing at a speaker-end of the casing, and the first microphone assembly is fixated relative to the casing distally with respect to the speaker-end, and the second group of microphones is mounted in a u-shaped slider having two legs and an interconnection connecting the legs.

12. The headset as claimed in claim 11, wherein the first microphone assembly comprises two microphones and the second microphone group comprises one microphone.

13. The headset as claimed in claim 11, wherein the microphones in the microphone boom are electret microphones with a membrane and wherein the microphones in the first group have microphone membranes arranged in a first common direction with respect to the headset and wherein the microphones of the second group have microphone membranes arranged perpendicular to said first direction.

14. The headset as claimed in claim 11, wherein the microphones in the microphone boom and the speaker are arranged in a common plane, and the two legs of the u-shaped slider are provided to slide in tracks provided at two opposite sides of the common plane.

15. The headset as claimed in claim 11, wherein the two legs of the u-shaped slider form exterior surface parts along the casing and the microphone in the second group is situated at the interconnection between the two legs of the u-shaped part.

16. The headset as claimed in claim 10, wherein the first and the second axis are always parallel.

17. The headset as claimed in claim 15, wherein a cam follower and a cam surface opposing each other is provided between a leg of the u-shaped slider and an opposed surface of a track in the casing, such that the cam follower is elastically pressed against the cam surface by a spring and slides along said surface during motion of the u-shaped slider between open and closed positions.

18. The headset as claimed in claim 17, wherein the spring is elastically deformed when the u-shaped slider is between the open and the closed position and is most un-deformed when the slider is at its closed or open positions.

19. The headset as claimed in claim 18, wherein the cam surface is arranged to gradually deform the spring during motion from a closed or open position to a position at a point between closed and open positions, such that a maximum deformation of the cam follower is reached at this point.

* * * * *